US005137162A

United States Patent [19]

Fritz

[11] Patent Number: 5,137,162

[45] Date of Patent: Aug. 11, 1992

[54] CAP ASSEMBLY FOR A CONTAINER

[76] Inventor: Adam Fritz, P.O. Box 948, Potsdam, N.Y. 13676

[21] Appl. No.: 663,453

[22] Filed: Mar. 4, 1991

[51] Int. Cl.[5] ..... B65D 1/02

[52] U.S. Cl. ..... 215/31; 215/275; 215/283; 220/320; 285/245; 285/415

[58] Field of Search ..... 215/31, 274, 275, 276, 215/283, 284; 220/319, 320, 321, 85 SP; 285/242, 245, 252, 253, 254, 410, 411, 415

[56] References Cited

U.S. PATENT DOCUMENTS

| | | | |
|---|---|---|---|
| 406,888 | 7/1889 | Davis | 285/415 |
| 1,917,946 | 7/1933 | MacCordy | 215/274 |
| 2,685,978 | 8/1954 | Crockett | 222/511 |
| 2,715,477 | 8/1955 | North | 220/320 |
| 2,954,896 | 10/1960 | Russell et al. | 220/320 |
| 3,193,129 | 7/1965 | Pfluger et al. | 220/321 X |
| 3,411,813 | 11/1968 | Kreuz | 285/332 |
| 3,421,652 | 1/1969 | Warman | 220/320 |
| 3,483,089 | 12/1969 | Brewer | 435/287 |
| 4,063,760 | 12/1977 | Moreiras | 285/242 |
| 4,225,162 | 9/1980 | Dola | 285/161 |
| 4,253,583 | 3/1981 | Lynch | 220/319 |
| 4,313,629 | 2/1982 | Winterhalter | 285/242 |
| 4,347,944 | 9/1982 | Moldrup | 220/320 |
| 4,432,572 | 2/1984 | Thalmann | 285/412 |
| 4,448,448 | 5/1984 | Pollia | 285/112 |
| 4,541,537 | 9/1985 | Sailor | 215/274 |
| 4,582,208 | 4/1986 | Volf et al. | 215/274 |
| 4,660,266 | 4/1987 | Horn | 29/417 |

*Primary Examiner*—Stephen Marcus
*Assistant Examiner*—Nova Stucker
*Attorney, Agent, or Firm*—Bacon & Thomas

[57] ABSTRACT

A cap assembly for a container, such as a "beer ball", is disclosed wherein a cap member is removably attached to a neck, portion of the container. The assembly includes a seal between the cap member and the container neck and uses a split ring to urge the cap member into contact with the container neck in order to keep them sealed. The cap member has a first cam surface which interacts with a second cam surface formed on the split ring member to convert a transverse force exerted on the cap member by the split ring member into a generally axial force acting on the cap member to urge it into contact with the container neck. The cap member may close the end of the container neck and may also be used to attach various accessories to the container.

21 Claims, 2 Drawing Sheets

CAP ASSEMBLY FOR A CONTAINER

BACKGROUND OF THE INVENTION

The present invention relates to a cap assembly for a container, more specifically a reusable cap assembly for a container used in a brewing process.

The manufacture of beer is a complex natural process involving three general steps: the preparation of barley by germination (the malting process); the digestion of the barley or malt starch to produce a solution of sugars (wort); and the fermentation of the sugars by yeast. The fermentation of the wort is carried out by adding yeast to the wort immediately after it is cooled and as it is being transferred to a fermenter. In large, commercial breweries, the traditional fermenter is a horizontal cylinder having a capacity of approximately 1,000 barrels. Some major breweries have fermenters comprising vertical tanks with a capacity of 6,000–8,000 barrels. The yeast/wort mixture is stored in these fermenters for approximately one week.

Since the fermentation process produces alcohols, esters, aldehydes and ketones, along with sulfur-containing materials and organic acids, the fermenters must be made of a high-strength material, such as stainless steel. Of course, after each fermentation process, the fermenters must be cleaned to prevent the residue from contaminating the next fermentation batch.

Quite obviously, the construction and maintenance of such large fermenters requires a vast expenditure of capital and manpower. Such expenditures are well beyond the means of the so called "micro breweries" (commercial breweries producing very small quantities of specialized beer) and home brewers. Smaller containers, known as "beer balls", are commercially available to such "micro breweries" and home brewers to provide the relatively small storage quantities needed for their fermentation processes. However, these commercially available "beer balls" have not proven entirely satisfactory since it is often impossible to effectively seal the opening to contain the internal pressures generated by the fermentation process. Of course, without the proper seal, the batch is usually ruined.

Furthermore, the commercially available "beer balls" are generally not reusable, nor do they permit the attachment of accessories used in the fermenting process, such as an airlock, a tap, etc.

SUMMARY OF THE INVENTION

A cap assembly for a container, such as a "beer ball", is disclosed wherein a cap member is removably attached to a neck portion of the container. The assembly includes a seal between the cap member and the container neck and uses a split ring to urge the cap member into contact with the container neck, in order to keep them sealed.

The cap member has a first cam surface which interacts with a second cam surface formed on the split ring member to convert a transverse force exerted on the cap member by the split ring member into a generally axial force acting on the cap member to urge it into contact with the container neck. The interaction of the respective cam surfaces converts the generally transverse forces of the split ring member to generally axial forces acting on the cap member.

The cap member may close the end of the container neck and may also be used to attach various accessories to the container. Such accessories may include an airlock, which enables the use of the beer ball as either a primary or secondary fermenter, or may include standard "beer ball" accessories, such as taps, etc.

DETAILED DESCRIPTION OF THE PREFERRED EMBODIMENT

Figure 1:
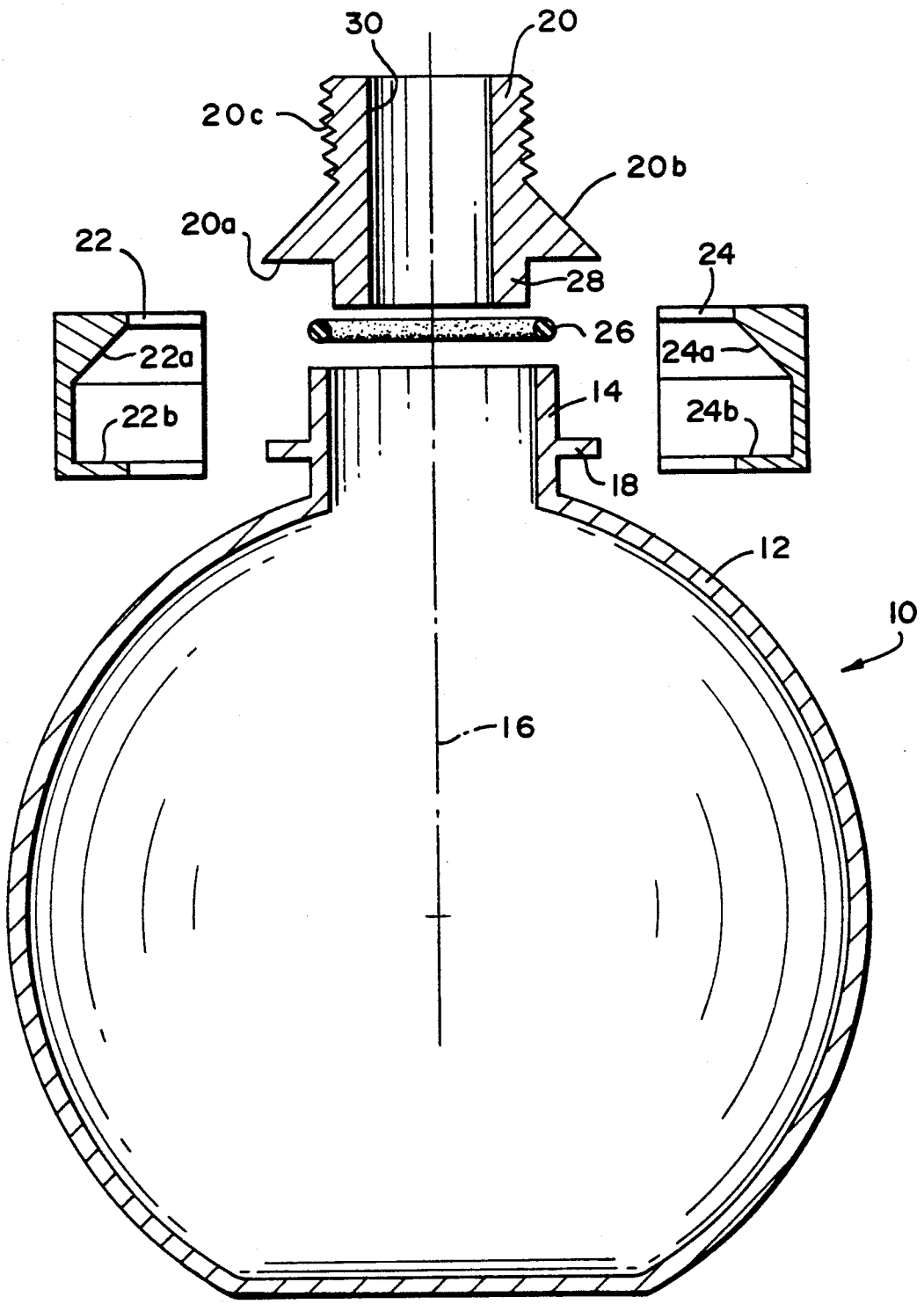
FIG. 1 is an exploded, cross-sectional view a container and the cap assembly according to the invention.

A standard, commercially available container, such as a "beer ball", is illustrated at 10 in FIG. 1 and generally comprises a container portion 12 having a neck portion 14 extending therefrom concentric about axis 16. Neck portion 14 typically has a generally radially extending flange 18 extending therefrom at least around a portion of its circumference. Container 10 is typically made from stainless steel, but may be made from any material without exceeding the scope of this invention.

The cap assembly according to the present invention comprises a cap member 20, split ring members 22 and 24, and may include a seal member 26. Seal member 26 may be a standard, commercially available "O"-ring seal as is well-known in the art.

Figure 2:
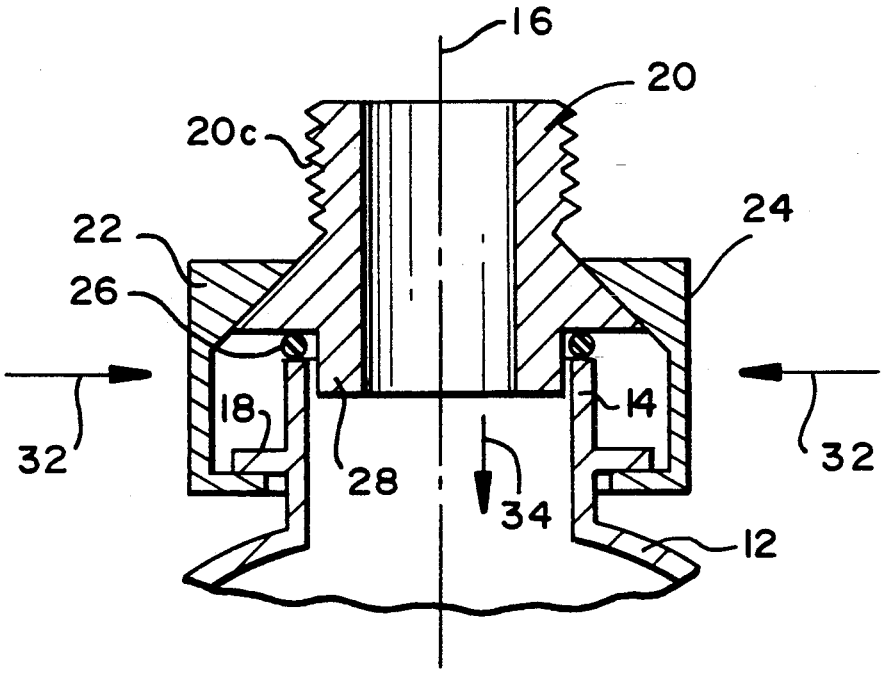
FIG. 2 is a partial, cross-sectional view illustrating the cap assembly according to the invention attached to the container shown in FIG. 1.

Cap member 20 has a shank portion 28 sized so as to be slidably received within the opening of the neck portion 14, as illustrated in FIG. 2. Cap member 20 may also define a sealing surface **20*a* which may bear against seal member 26 in the assembled positions. Cap member 20 also defines a first cam surface 20*b* extending at least around a major portion of its circumference. Opening 30 may also be defined through the general center of the cap member 20 so as to also extend generally parallel to axis 16. Threads 20*c* may be formed externally on the cap member 20**.

Split ring members 22 and 24 are semi-annular structures having a mirror-image configurations. The interior of each of the split ring members 22 and 24 defines second cam surfaces **22*a* and 24*a*, respectively. Generally transverse flanges 22*b* and 24*b* extend inwardly toward the neck portion 14 from each of the split ring members 22 and 24**.

As best illustrated in FIG. 2, the cap member 20 and the seal member 26 are placed over the distal end of the neck portion 14 such that the seal member is interposed between this end portion and the cap member 20. The semi-annular split ring members 22 and 24 are then placed about the cap member and the neck portion such that cam surfaces **22*a* and 24*a* contact cam surface 20*b*, and flanges 22*b* and 24*b* contact flange 18 formed on the neck portion 14. It is quite evident, that a constricting force applied to the split ring members 22 and 24 urging them closer together, in the direction of arrows 32, will exert a force on the cap member 20 urging it in the direction of arrow 34. This force will cause the cap member 20 to seal against the neck portion 14 of the container 12**.

Figure 3:
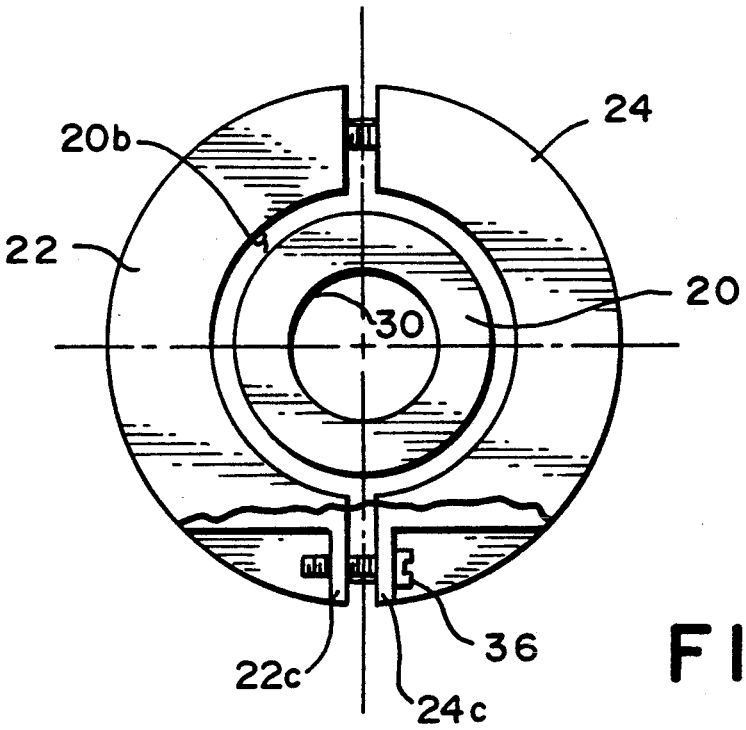
FIG. 3 is a top view of the cap assembly shown in FIGS. 1 and 2.

One way of exerting the constricting force of the split ring members 22 and 24 is illustrated in FIG. 3. Each of the split ring members define a wall portion **22*c* and 24*c*, respectively, through which passes a threaded member 36, such as a screw. Although only one such assembly is illustrated in FIG. 3, it is to be understood that the diametrically opposite portions of split ring members 22 and 24 have the same structure. Thus, by tightening the screws 36, split ring members 22 and 24 will be urged in the direction of arrows 32**. Quite obviously, other means of applying the constricting force to the split ring members may be utilized without exceeding the scope of this invention.

The foregoing description is provided for illustrative purposes only and should not be construed as anyway limiting this invention, the scope of which is defined solely by the appended claims.

I claim:

1. In combination; a cap member, a generally cylindrical element having a longitudinal axis and an open end and a device for attaching the cap member to the generally cylindrical element, the combination comprising:

a) a flange extending generally radially outwardly from the generally cylindrical element and spaced from the open end thereof;

b) a cap member defining a first cam surface forming an acute angle with the longitudinal axis, a shank portion adapted to be inserted into the end of the cylindrical element and a sealing surface;

c) a split ring member having thereon means to engage the generally radially outwardly extending flange and defining a second cam surface adapted to contact the first cam surface; and, d) constricting means operatively associated with the split ring member to apply a force to the split ring member generally transverse to the longitudinal axis such that contact between the first and second cam surfaces imparts a generally axially directed force on the cap member urging the sealing surface against the open end of the generally cylindrical element.

2. The combination of claim 1 further comprising a seal member operatively interposed between the sealing surface of the cap member and the open end of the generally cylindrical element.

3. The combination of claim 1 further comprising an opening defined by the cap member so as to communicate with the interior of the generally cylindrical element.

4. The combination of claim 1 further comprising a threaded portion defined on the cap member.

5. The combination of claim 4 wherein the threaded portion is defined on an exterior portion of the cap member.

6. The combination of claim 1 wherein the split ring member comprises a pair of mirror image, semi-annular portions.

7. The combination of claim 6 wherein the constricting means comprises at least one threaded member operatively extending between the pair of semi-annular portions.

8. The combination of claim 7 further comprising a seal member operatively interposed between the cap member and the end of the generally cylindrical element.

9. The combination of claim 8 further comprising an opening defined by the cap member so as to communicate with the interior of the generally cylindrical element.

10. The combination of claim 9 further comprising a threaded portion defined on the cap member.

11. The combination of claim 10 wherein the threaded portion is defined on an exterior portion of the cap member.

12. In combination; a cap member, a generally cylindrical neck portion having a longitudinal axis and a distal end and a device for attaching the cap member to the generally cylindrical neck portion, the combination comprising:

a) a cap member defining a first cam surface forming an acute angle with the longitudinal axis, a shank portion adapted to be inserted into the neck portion and a sealing surface;

b) a flange extending generally radially outwardly from the neck portion and spaced from the distal end thereof;

c) a split ring member having thereon means to engage the generally radially outwardly extending flange and defining a second cam surface adapted to contact the first cam surface; and, d) constricting means operatively associated with the split ring member to apply a force to the split ring member generally transverse to the longitudinal axis such that contact between the first and second cam surfaces imparts a generally axial force on the cap member urging the sealing surface against the distal end of the neck portion.

13. The combination of claim 12 further comprising a seal member operatively interposed between the sealing surface of the cap member and the distal end of the neck portion.

14. The combination of claim 12 further comprising an opening defined by the cap member communicating with the interior of the container.

15. The combination of claim 14 further comprising an external threaded portion defined by the cap member.

16. The combination of claim 12 wherein the split ring member comprises a pair of mirror image, semi-annular portions.

17. The combination of claim 16 wherein the constricting means comprises at least one threaded member operatively extending between the pair of semi-annular portions.

18. The combination of claim 12 wherein the first cam surface and the sealing surface form an acute angle therebetween.

19. The combination of claim 18 wherein the sealing surface extends generally parallel to the generally radially outwardly extending flange.

20. The combination of claim 1 wherein the first cam surface and the sealing surface form an acute angle therebetween.

21. The combination of claim 20 wherein the sealing surface extends generally parallel to the generally radially outwardly extending flange.

* * * * *